US009486017B2

(12) United States Patent
Liu

(10) Patent No.: US 9,486,017 B2
(45) Date of Patent: Nov. 8, 2016

(54) ANTI-ODOR APPAREL

(71) Applicant: John Liu, Taipei (TW)

(72) Inventor: John Liu, Taipei (TW)

( * ) Notice: Subject to any disclaimer, the term of this patent is extended or adjusted under 35 U.S.C. 154(b) by 122 days.

(21) Appl. No.: 14/456,696

(22) Filed: Aug. 11, 2014

(65) Prior Publication Data

US 2014/0345030 A1 Nov. 27, 2014

Related U.S. Application Data

(63) Continuation-in-part of application No. 13/486,712, filed on Jun. 1, 2012, now abandoned.

(51) Int. Cl.

| | |
|---|---|
| ***A41D 27/10*** | (2006.01) |
| ***A41D 1/04*** | (2006.01) |
| *A41D 27/13* | (2006.01) |

(52) U.S. Cl.

CPC ..... *A41D 1/04* (2013.01); *A41D 27/10* (2013.01); *A41D 27/13* (2013.01); *A41D 2300/50* (2013.01); *A41D 2400/34* (2013.01); *A41D 2400/36* (2013.01); *A41D 2600/10* (2013.01)

(58) Field of Classification Search

CPC ..... A41D 2400/34; A41D 2400/36; A41D 27/13; A41D 27/10; A41D 2300/50

See application file for complete search history.

(56) References Cited

U.S. PATENT DOCUMENTS

| | | | | |
|---|---|---|---|---|
| 601,489 | A * | 3/1898 | Tim | A41D 27/28 2/115 |
| 1,269,805 | A * | 6/1918 | Felberbaum | A41D 27/10 2/126 |
| 2,687,527 | A | 8/1954 | Rendino | |
| 3,801,987 | A * | 4/1974 | Thompson, Jr. | A41D 27/10 2/125 |
| 5,042,089 | A | 8/1991 | Carmer | |
| 6,138,276 | A | 10/2000 | Asciutto et al. | |
| 6,145,129 | A | 11/2000 | Czekalla et al. | |
| 6,178,557 | B1 | 1/2001 | Bel Monte | |
| 6,836,901 | B2 | 1/2005 | Hippensteel | |
| 7,752,681 | B2 | 7/2010 | Michel | |
| 2008/0086791 | A1 | 4/2008 | Kirkwood Samuel et al. | |

* cited by examiner

*Primary Examiner* — Anna Kinsaul

(74) *Attorney, Agent, or Firm* — Muncy, Geissler, Olds & Lowe, P.C.

(57) ABSTRACT

An anti-odor apparel includes: an upper body clothing that defines an open end; an extended sleeve stitched to the open end to form a loop-shaped sewing connection, the extended sleeve having a sleeve segment and an extension segment which respectively have lower end portions that are made from a functional fabric; and a lifting unit including an elastic string that has two connecting end portions and that extends along the loop-shaped sewing connection. The connecting end portions of the elastic string are held to the loop-shaped sewing connection such that the elastic string is held under tension so as to elastically lift at least one of the lower end portions of the sleeve segment and the extension segment toward the user's underarm area.

8 Claims, 17 Drawing Sheets

ANTI-ODOR APPAREL

CROSS-REFERENCE TO RELATED APPLICATION

This application is a continuation-in-part of U.S. patent application Ser. No. 13/486,712, filed on Jun. 1, 2012, the entire disclosure of which is incorporated herein by reference.

FIELD OF THE INVENTION

This invention relates to an anti-odor apparel, more particularly to an underarm anti-odor apparel including an extended sleeve that has at least antibacterial function, and a lifting unit for lifting the extended sleeve.

DESCRIPTION OF THE RELATED ART

Human body odor is mainly caused by skin glands excretions and bacterial activity. Considering the different types of skin glands, human body odor is primarily the result of the apocrine sweat glands, which secrete the majority of chemical compounds needed for the skin flora to metabolize into odorant substances. This happens mostly in the axillary (armpit) region, although the gland can also be found in the areola, anogenital region, and around the navel. As illustrated in FIG. 1, light yellow stains are left on armpit-covering portions 91 of a clothing 9 due to body fluids, such as sweat. Although body odor does not affect human health, it causes many problems on social and interpersonal relationships. Since the odor is caused by three factors: perspiration, bacterial, and stuffy and humid environment of the underarm, underarm odor elimination may be achieved through at least antibacterial application and additionally perspiration deodorization and/or perspiration control. Generally, there are several means to solve the odor problem, as discussed below:

1. Antiperspirant and Deodorant:

Advantage: Readily available at an affordable price, and generally applied directly to the underarm;

Disadvantage: possible body skin allergy, increasing the possibility of getting breast cancer, inhibiting perspiration being an unnatural behavior, causing sweat stains on clothing, and requiring reapplication to sustain deodorant effects;

2. Armpit patch:

Advantage: minimal impact to human health because of no direct application to the skin, being disposable and sanitary, attachable to a variety of clothing, and being readily replaceable;

Disadvantage: possible user discomfort due to the sticky and wet patches, being identifiable from appearance, possible damage to the fabric of the clothing when the patch is torn off, likely to fall off from clothing, and burdening the user financially with daily long-term usage;

3. Additional functional fabric cut pieces 92 (see FIG. 2) deposited over or directly sewn to armpit parts of an apparel 9:

Advantage: Garment can be repeatedly used after washing and it is cheaper to use than the armpit patch;

Disadvantage: when the user raises his or her arm, the additional cut pieces 92 and the extra stitches might be identifiable from appearance.

4. Full-piece antibacterial and deodorant clothing:

Advantage: such clothing solves the drawbacks of the armpit patch and the apparel with the additional functional fabric cut pieces 92 in the armpit regions;

Disadvantage: commercially available full-piece functional garments usually do not work for underarm odors because they usually do not contain the right kind(s) of functional materials and/or the right amount of functional materials to achieve the deodorant effects for the underarm. Since functional fiber materials are expensive, an apparel with both the right kind (s) and right amount of functional fiber materials in the whole garment will make it too expensive and infeasible to manufacture.

SUMMARY OF THE INVENTION

Therefore, an object of the present invention is to provide an underarm anti-odor apparel that can overcome at least one of the aforesaid drawbacks associated with the prior art.

According to one aspect of this invention, there is provided an anti-odor apparel that comprises: an upper body clothing that defines an open end; an extended sleeve stitched to the open end of the upper body clothing to form a loop-shaped sewing connection, the loop-shaped sewing connection being configured to surround an underarm area of an upper body of the user, the extended sleeve having an open free end that is opposite to the loop-shaped sewing connection, a sleeve segment that extends from the open free end and that is configured to cover an arm area of the user, and an extension segment that extends from the sleeve segment to the loop-shaped sewing connection and that is configured to cover a portion of the shoulder area and a portion of the underarm area, the sleeve segment having a lower end portion, the extension segment having a lower end portion that extends from the lower end portion of the sleeve segment, the lower end portions of the sleeve segment and the extension segment being made from a functional fabric that has anti-odor effects, and being configured to be disposed underneath the underarm area for covering and contacting the underarm area; and a lifting unit including an elastic string that has two opposite connecting end portions and that is positioned at and that extends along the loop-shaped sewing connection. The connecting end portions of the elastic string are held to the loop-shaped sewing connection at two different lifting points of the loop-shaped sewing connection, respectively, such that the elastic string is held under tension so as to generate a lifting force that acts on the extended sleeve to elastically lift at least one of the lower end portions of the sleeve segment and the extension segment toward the underarm area.

According to another aspect of this invention, there is provided an anti-odor apparel that comprises: an upper body clothing that defines an open end; an extended sleeve having a generally curve-shaped sewing connection and stitched to the open end of the upper body clothing to form a loop-shaped sewing connection, the loop-shaped sewing connection intersecting the curve-shaped sewing connection and being configured to surround an underarm area of an upper body of the user, the extended sleeve having an open free end that is opposite to the loop-shaped sewing connection, a sleeve segment that extends from the open free end and that is configured to cover an arm area of the user, and an extension segment that extends from the sleeve segment to the loop-shaped sewing connection and that is configured to cover a portion of the shoulder area and a portion of the underarm area, the sleeve segment having a lower end portion, the extension segment having a lower end portion that extends from the lower end portion of the sleeve segment, the lower end portions of the sleeve segment and the extension segment being made from a functional fabric that has anti-odor effects, and being configured to be disposed underneath the underarm area for covering and contacting the underarm area; and a lifting unit including a pair of elastic members that are fastened to at least one of the lower end portions of the sleeve segment and the extension segment, the elastic members being respectively disposed at two opposite sides of the curve-shaped sewing connection and extending between the loop-shaped sewing connection and the curve-shaped sewing connection, such that the elastic members are held under tension so as to generate a lifting force that acts on the extended sleeve to elastically lift said at least one of the lower end portions of the sleeve segment and the extension segment toward the underarm area.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
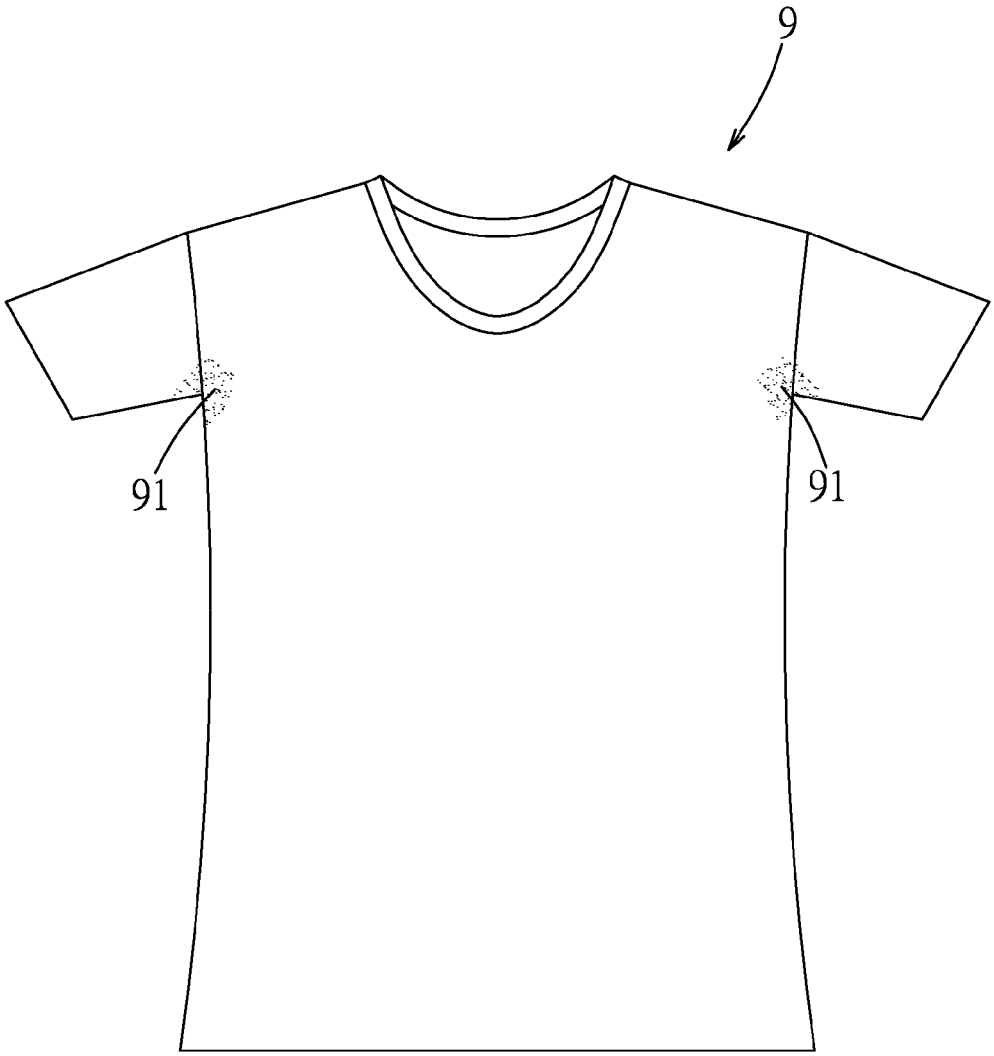
FIG. 1 PRIOR ART
FIG. 1 is a schematic view of a conventional apparel.
Figure 2:
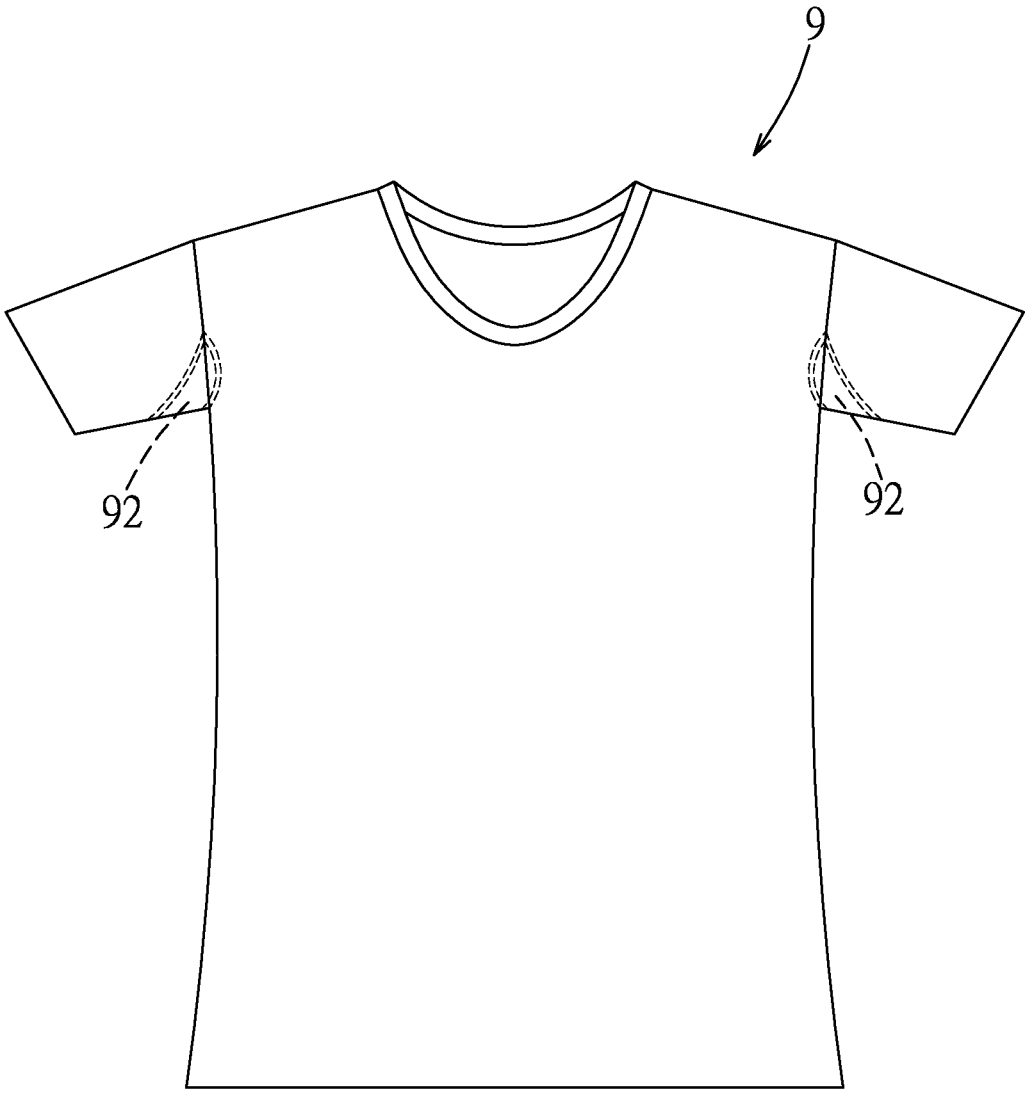
FIG. 2 PRIOR ART
FIG. 2 is a schematic view of another conventional apparel provided with functional fabric cut pieces.

Before the present invention is described in greater detail with reference to the accompanying embodiments, it should be noted herein that like elements are denoted by the same reference numerals throughout the disclosure.

The merits of the present invention will be described in the following embodiments of an underarm anti-odor apparel. The underarm anti-odor apparel of the present invention resembles a regular clothing without extra cut pieces and stitches, works for underarm odors with right and enough functional materials, and costs reasonably. Since the human armpit is located in the joint between the arm and the torso, using sleeves alone to achieve the aforesaid object was intentional because the sleeves are located next to the armpits and use less fabric. However, the following problem is encountered: the underarm is located partially in the upper arm and partially in the upper torso. To solve this problem, an extended sleeve without extra stitches is proposed. Moreover, achieving true underarm deodorant effects through anti-odor clothing requires the functional fabric underneath the underarm to not only cover but also touch the whole underarm. Without this requirement, the deodorant effects might drop. Certainly, fitted undergarments and garments may satisfy the requirement. However, not all apparels are designed to be fitted to the body, for example, T-shirts or dress shirts. Therefore, for these kinds of regular-fit or loose-fit apparels to satisfy the requirement, lifting devices that can generate lifting effects for underarm portions of the clothing are proposed (as particularly illustrated in the fourth, fifth, sixth, seventh, eighth, and ninth embodiments). The lifting devices may also satisfy the following requirements: they may lift lower end portions of the extended sleeve towards the armpit, the apparel appears as normal as possible when the lower end portions of the extended sleeve are lifted, they may allow the body to move naturally, it is best for the lifting devices to be concealed, the tension of the lift can be adjusted, it is best that the lifting devices are detachably engageable with the extended sleeve, and the lifting devises may be washable.

Figure 3:
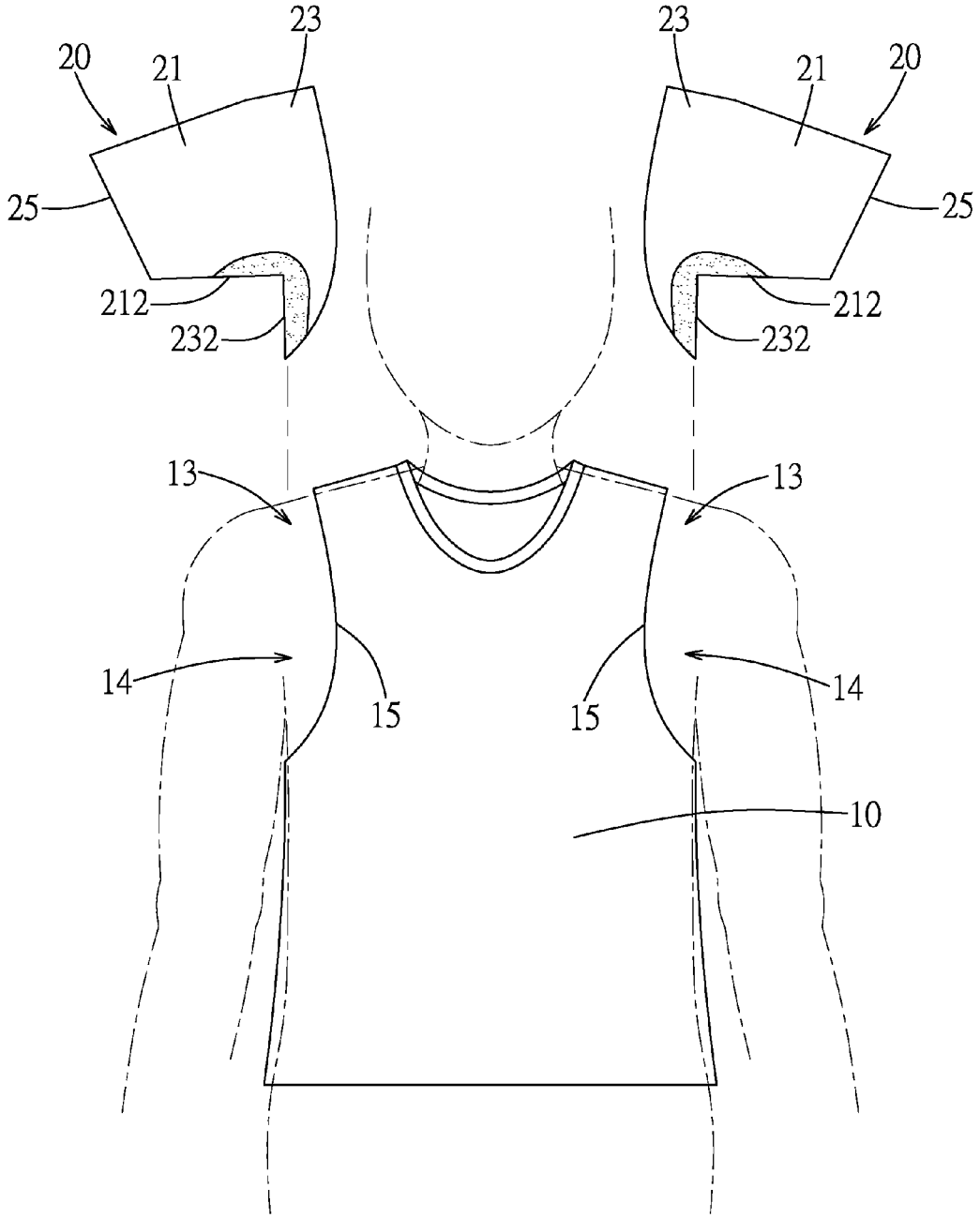
FIG. 3 is a schematic exploded view of the first embodiment of an anti-odor apparel according to the present invention.

FIG. 3 illustrates the first embodiment of an underarm anti-odor apparel according to the present invention for a user's upper body. The anti-odor apparel includes a sleeve-free upper body clothing 10 and two extended sleeves 20.

The upper body clothing 10 defines two opposite open ends 15, and is configured to cover partially the user's shoulder areas and a chest area, such that portions 13 of the user's shoulder areas, the user's side chest areas and side portions of the user's back area (not shown) are exposed from the upper body clothing 10.

Each of the extended sleeves 20 is stitched to a respective one of the open ends 15 of the upper body clothing 10, and has an open free end 25, a sleeve segment 21 that extends from the open free end 25, that has a lower end portion 212 and that is configured to cover one of the user's arm areas, and an extension segment 23 that extends from the sleeve segment 21 to a respective one of the open ends 15, that has a lower end portion 232 and that is configured to cover the portion 13 of one of the user's shoulder areas, one of the user's side chest areas, and one of the side portions of the user's back area (now shown). The lower endportion 232 of the extension segment 23 extends from and intersects the lower end portion 212 of the sleeve segment 21 at a location adjacent to the user's armpit. The lower end portions 212, 232 of the sleeve segment 21 and the extension segment 23 are made from a functional fabric that has at least anti-bacterial function as well as additional anti-odor functions, such as sweat-deodorizing, sweat-absorbent, moisture-wicking, quick-drying, breathable, and/or cooling, and are configured to be disposed underneath a respective one of underarm areas 14 of the user's upper body and to cover and contact the respective one of the underarm areas 14.

Figure 4:
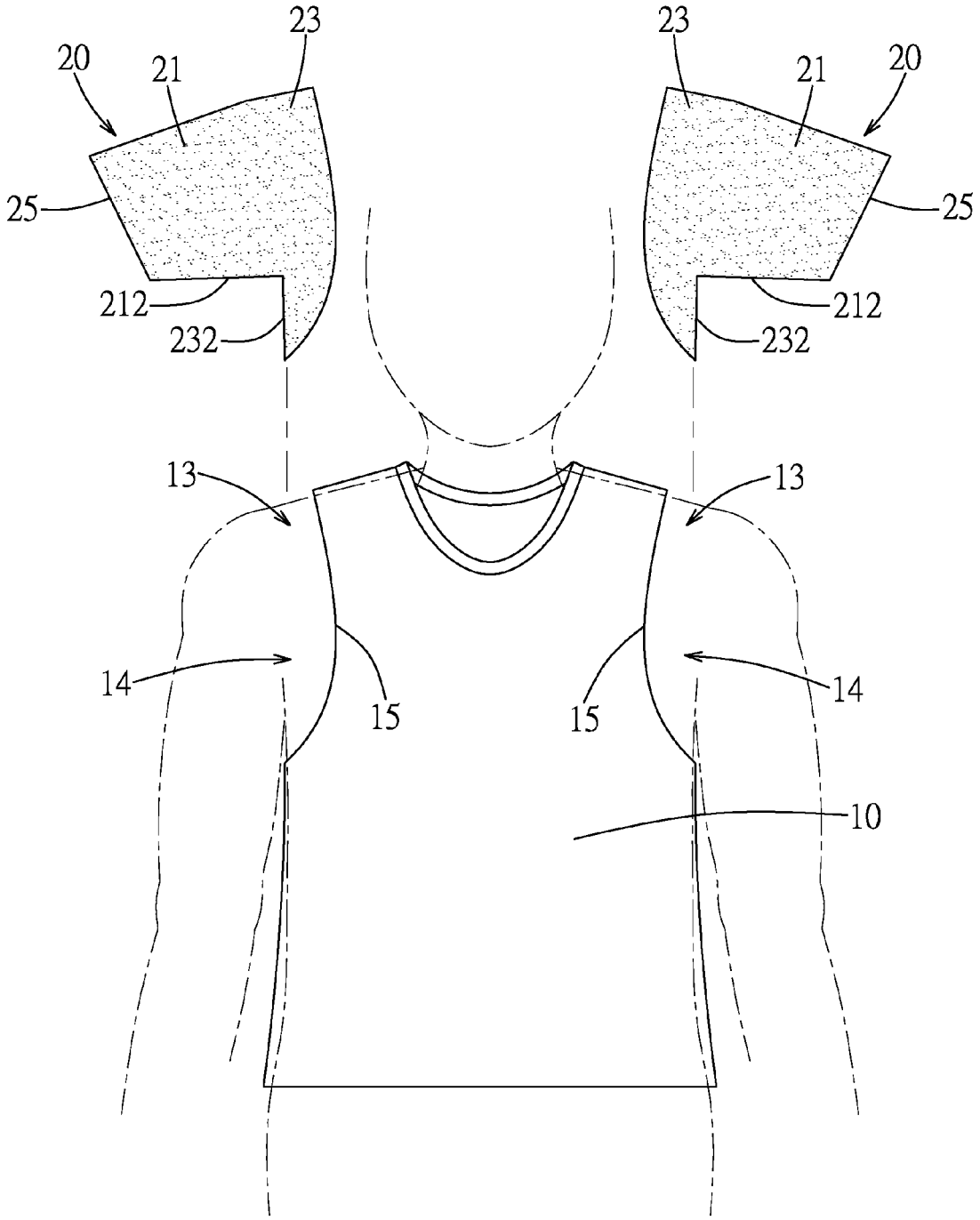
FIG. 4 is a schematic exploded view of the second embodiment of the anti-odor apparel according to the present invention.

FIG. 4 illustrates the second embodiment of the anti-odor apparel according to the present invention. The second embodiment differs from the previous embodiment in that each of the extended sleeves 20 is entirely made from the functional fabric.

Figure 5:
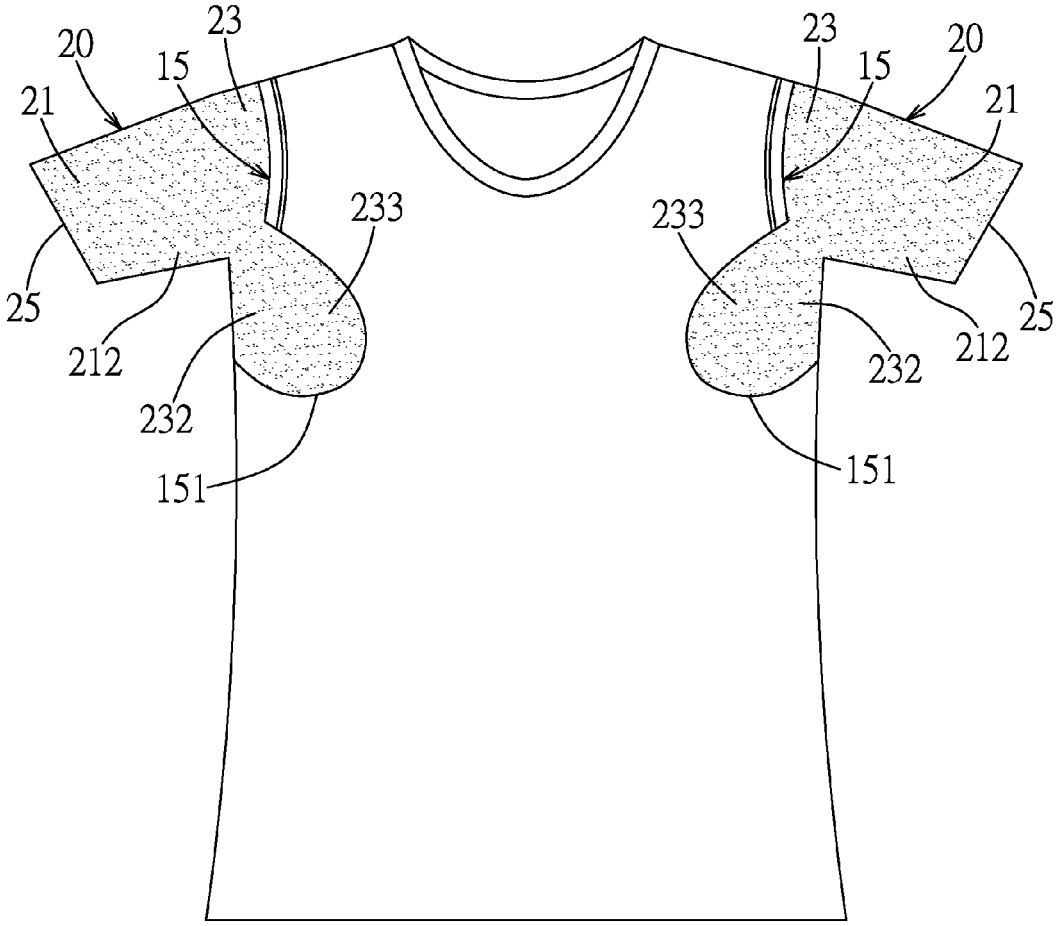
FIG. 5 is a schematic view of the third embodiment of the anti-odor apparel according to the present invention.

FIG. 5 illustrates the third embodiment of the anti-odor apparel according to the present invention. The third embodiment differs from the second embodiment in that each of the open ends 15 of the upper body clothing 10 has a concave section 151, and that the extension segment 23 further has a convex portion 233 which protrudes from the lower end portion 232 to the concave section 151 of a respective one of the open ends 15 and that is configured to cover a portion of the chest area of the user's body.

Figure 6:
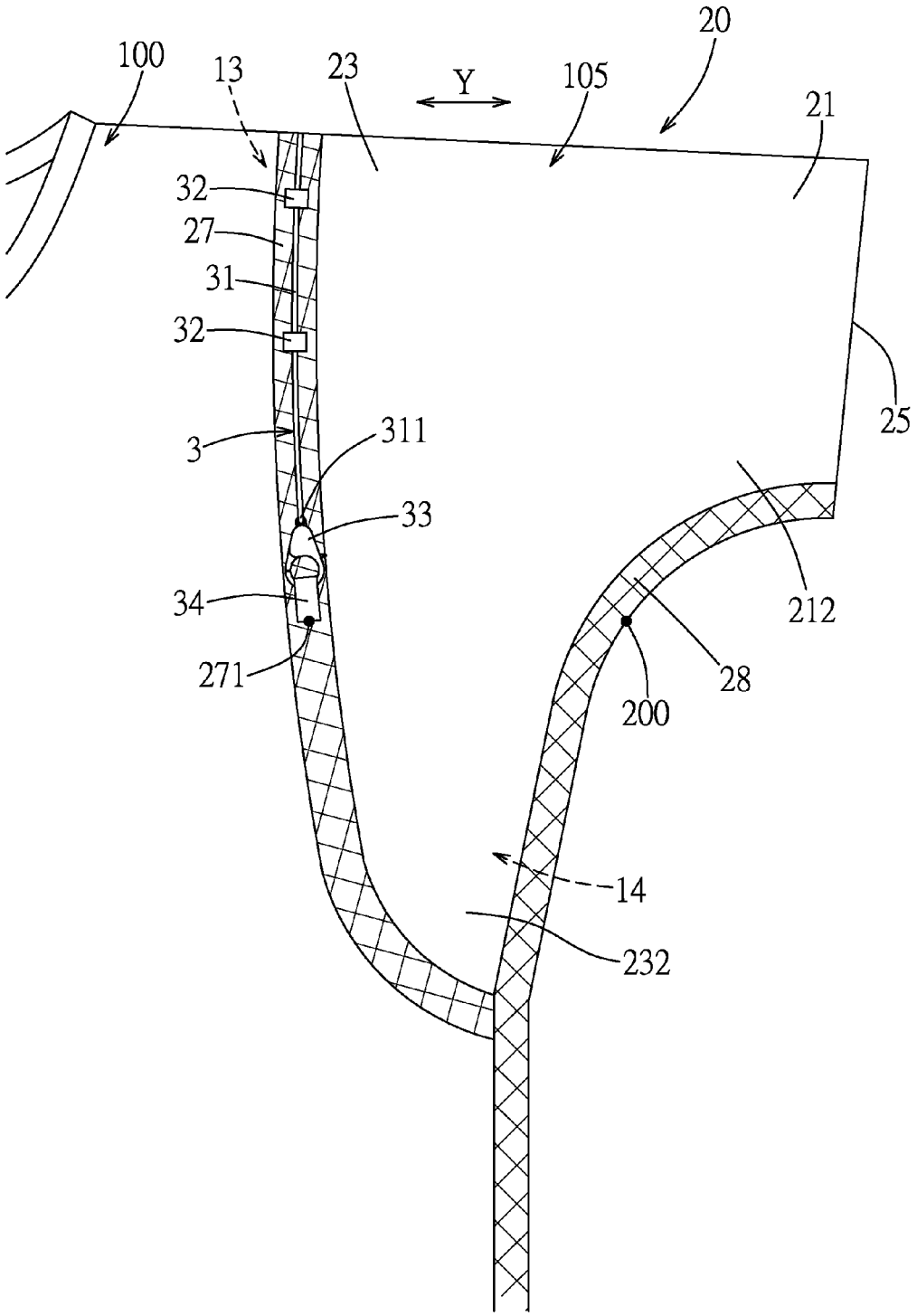
FIG. 6 is a schematic front view of the fourth embodiment of the anti-odor apparel according to the present invention, illustrating a state where first and second engaging members engage each other.
Figure 7:
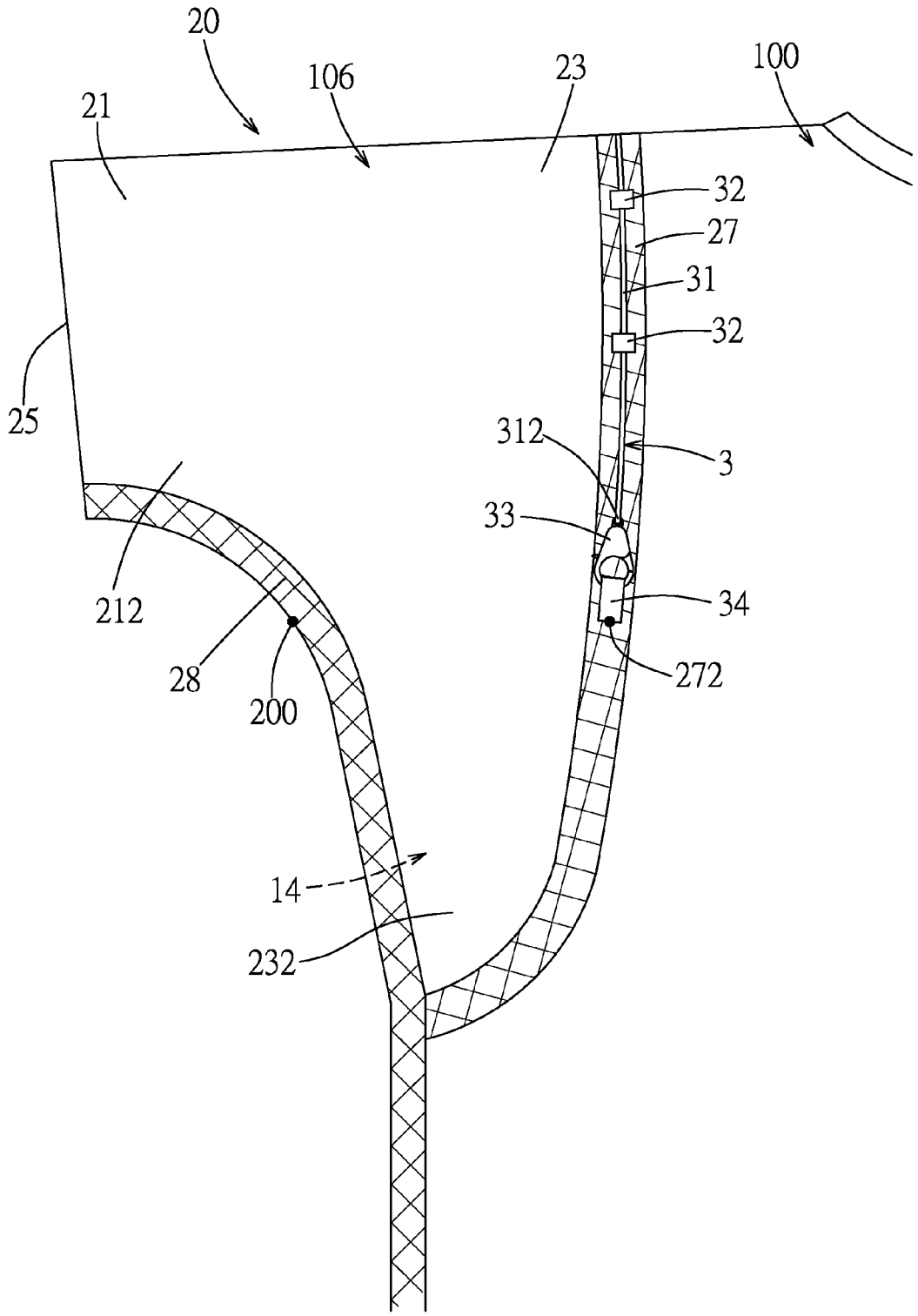
FIG. 7 is a schematic rear view of the fourth embodiment.
Figure 8:
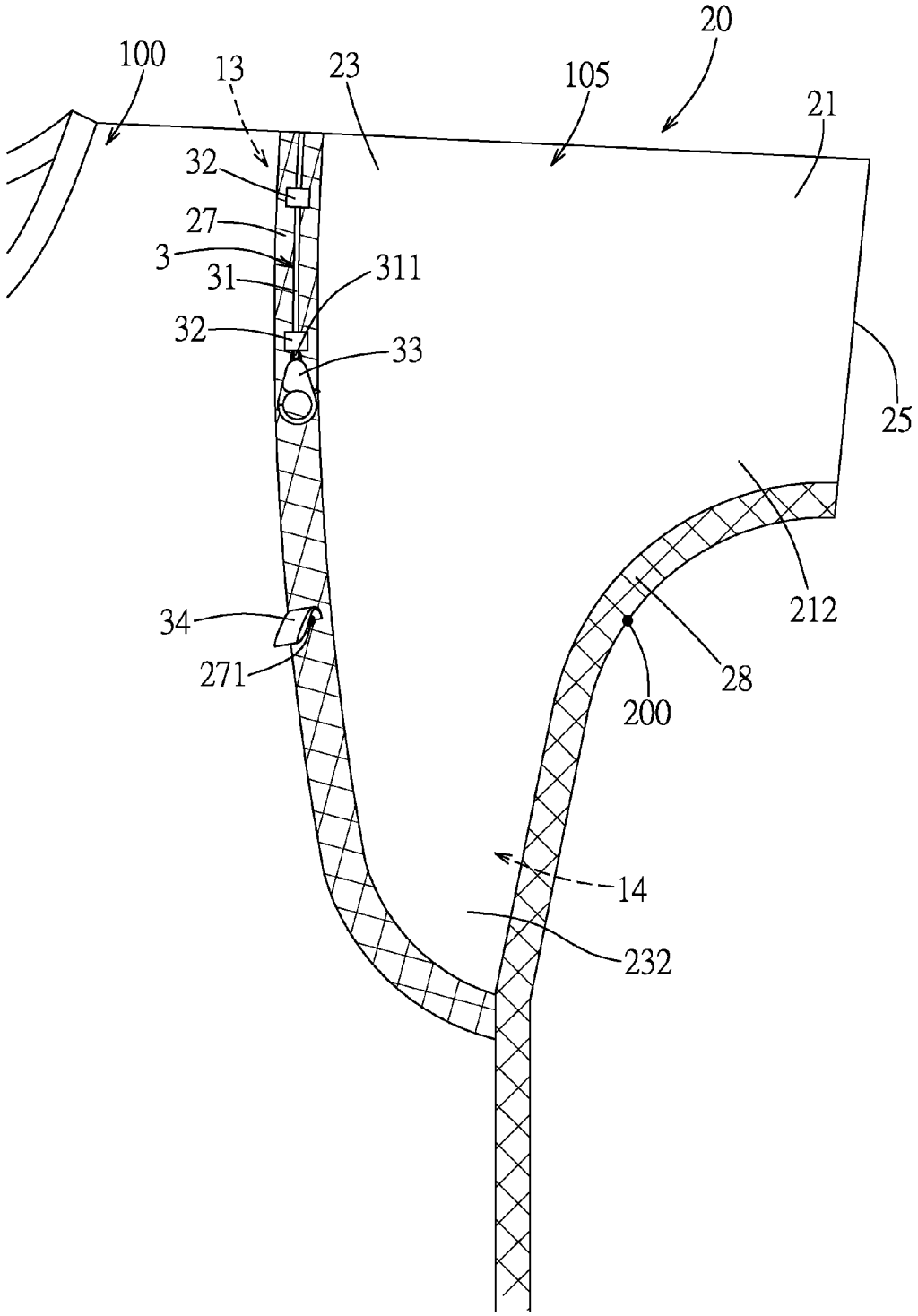
FIG. 8 is a schematic front view of the fourth embodiment, illustrating another state where the first and second engaging members disengage each other.

FIGS. 6 to 8 illustrate the fourth embodiment of the underarm anti-odor apparel according to the present invention. The fourth embodiment differs from the first embodiment mainly in that the anti-odor apparel further includes a pair of lifting units 3, and that the extended sleeves 20 are stitched to the open ends 15 of the upper body clothing 10 to form two opposite loop-shaped sewing connections 27, respectively, at an inner side 100 of the upper body clothing 10. In this embodiment, each of the extended sleeves 20 is entirely made from the functional fabric, and further has a generally curve-shaped sewing connection 28 which intersects and extends from the respective loop-shaped sewing connection 27 to the open free end 25 and which is disposed at bottoms of the lower end portions 212, 232 of the sleeve segment 21 and the extension segment 23. Each of the loop-shaped sewing connections 27 is disposed opposite to the open free end 25 of the respective one of the extended sleeves 20 in an arm-extension direction (Y).

Each of the loop-shaped sewing connections 27 is configured to surround a portion 13 of the respective shoulder area of the user's upper body, a portion of the chest area of the user's upper body, a portion of the back area of the user's upper body and the respective underarm area 14 of the user's upper body.

Each of the lifting units 3 includes a first elastic string 31, two first engaging members 33 and two second engaging members 34. The first elastic string 31 has two opposite connecting end portions 311, 312, and is positioned at and extends along an inverted U-shaped upper portion of a respective one of the loop-shaped sewing connections 27. In this embodiment, the first elastic string 31 is detachably connected to the loop-shaped sewing connections 27, so that the first elastic string 31 is replaceable. The first engaging members 33 are respectively secured to the connecting end portions 311, 312 of the first elastic string 31. The second engaging members 34 are respectively secured to two different lifting points 271, 272 of the respective loop-shaped sewing connection 27, and are releasably and respectively engageable with the first engaging members 33 (see FIGS. 6 and 7). The connecting end portions 311, 312 of the first elastic string 31 are held to the loop-shaped sewing connection 27 at the two different lifting points 271, 272 of the loop-shaped sewing connection 27 through engagement between the first and second engaging members 33, 34, respectively, such that the first elastic string 31 is held under tension so as to generate two lifting forces that respectively act on the lifting points 271, 272 and on the extended sleeve 20 to elastically lift at least one of the lower end portions 212, 232 of the sleeve segment 21 and the extension segment 23 toward the user's underarm area 14. FIG. 8 illustrates a state where the first and second engaging members 33, 34 disengage each other. It is noted that the lifting points 271, 272 are respectively disposed on front and back sides 105, 106 of the anti-odor apparel, and each is disposed at an armpit-location 200 of the anti-odor apparel which is disposed at a level substantially the same as that of the user's armpit.

In this embodiment, each of the first engaging members 33 is in the form of a hook, and each of the second engaging members 34 is in the form of a ring that is secured to the respective one of the lifting points 271, 272 of the loop-shaped sewing connection 27. Alternatively, the first engaging members 33 may be in the form of one of male and female snap buttons, and the second engaging members 34 may be in the form of the other of the male and female snap buttons.

In this embodiment, each of the lifting units 3 further includes a plurality of positioning loops 32 that are stitched to a respective one of the loop-shaped sewing connections 27 and that are spaced apart from one another. Each of the positioning loops 32 defines a loop hole. The first elastic string 31 extends through the loop holes in the positioning loops 32 so as to be positioned along the loop-shaped sewing connection 27.

Figure 9:
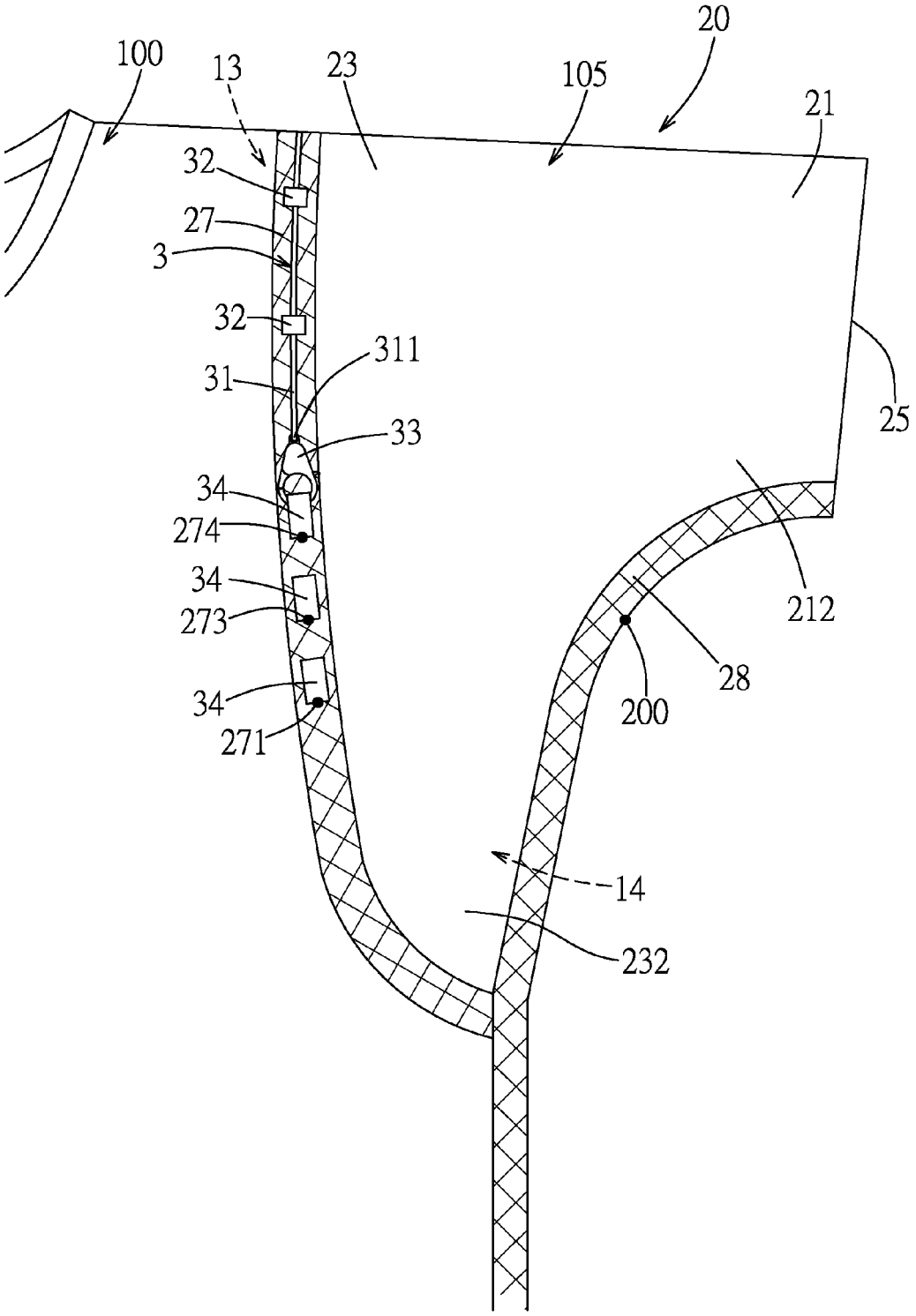
FIG. 9 is a schematic front view of the fifth embodiment of the anti-odor apparel according to the present invention.

FIG. 9 illustrates the fifth embodiment of the anti-odor apparel according to the present invention. The fifth embodiment differs from the fourth embodiment in that each of the lifting units 3 further includes a plurality of additional second engaging members 34 that are spaced apart from each other and that are respectively secured to additional lifting points 273, 274 of the loop-shaped sewing connection 27. Each first engaging member 33 engages releasably a selected one of the second engaging members 34 to enable adjustment of the tension of the first elastic string 31.

Figure 10:
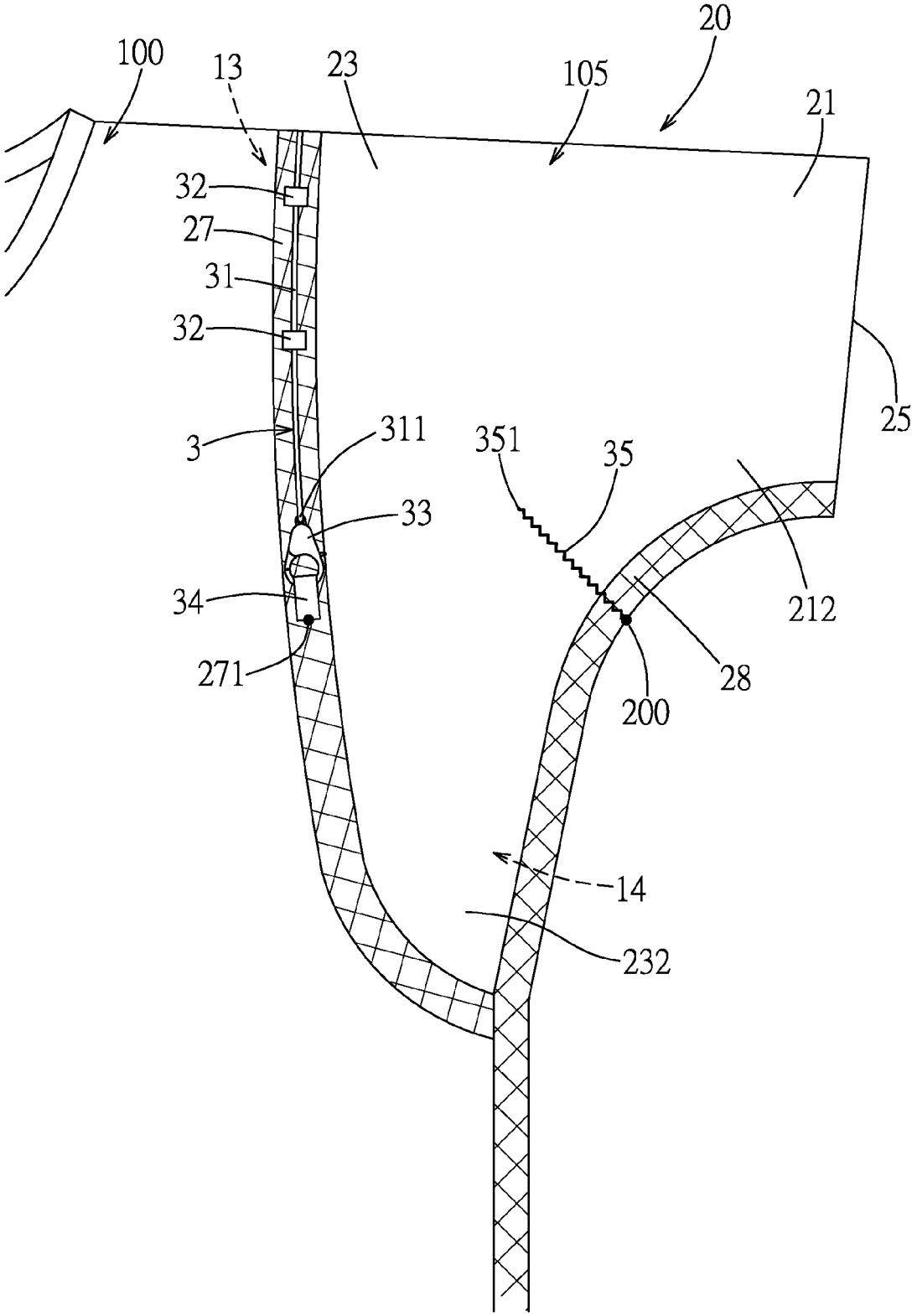
FIG. 10 is a schematic front view of the sixth embodiment of the anti-odor apparel according to the present invention.
Figure 11:
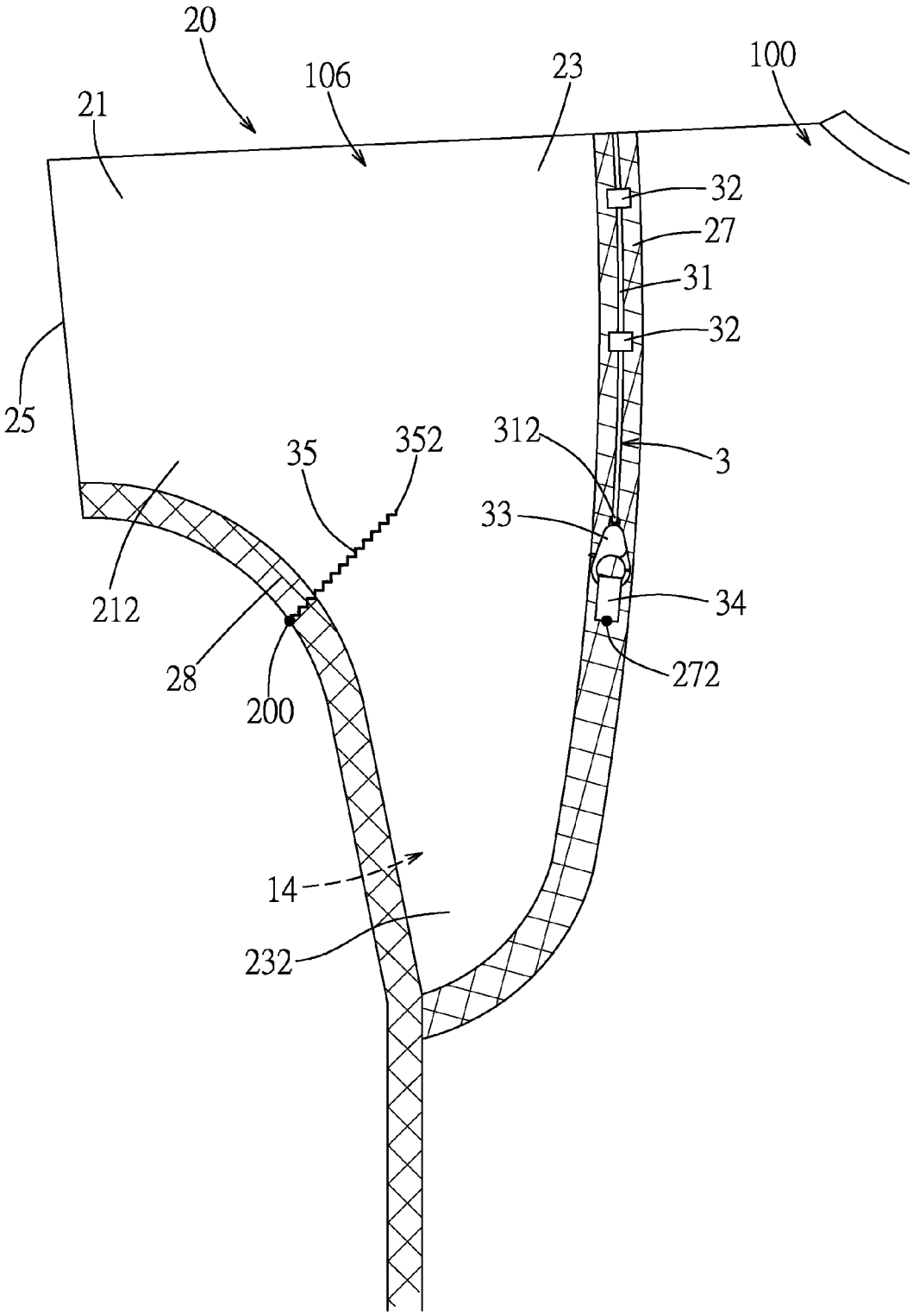
FIG. 11 is a schematic rear view of the sixth embodiment.

FIGS. 10 and 11 illustrate the sixth embodiment of the anti-odor apparel according to the present invention. The sixth embodiment differs from the fourth embodiment in that each of the lifting units 3 further includes a second elastic string 35 which is stitched to at least one of the lower end portions 212, 232 of the sleeve segment 21 and the extension segment 23 of a respective one of the extended sleeves 20. The second elastic string 35 intersects the curve-shaped sewing connection 28, such that the second elastic string 35 is held under tension so as to generate a lifting force that acts on at least one of the lower end portions 212, 232 of the sleeve segment 21 and the extension segment 23 to elastically lift the at least one of the lower end portions 212, 232 of the sleeve segment 21 and the extension segment 23 toward the user's underarm area 14. Preferably, the second elastic string 35 intersects the armpit-location 200 of the anti-odor apparel, and has two opposite ends 351, 352 that are respectively disposed at the front and back sides 105, 106 of the anti-odor apparel.

Figure 12:
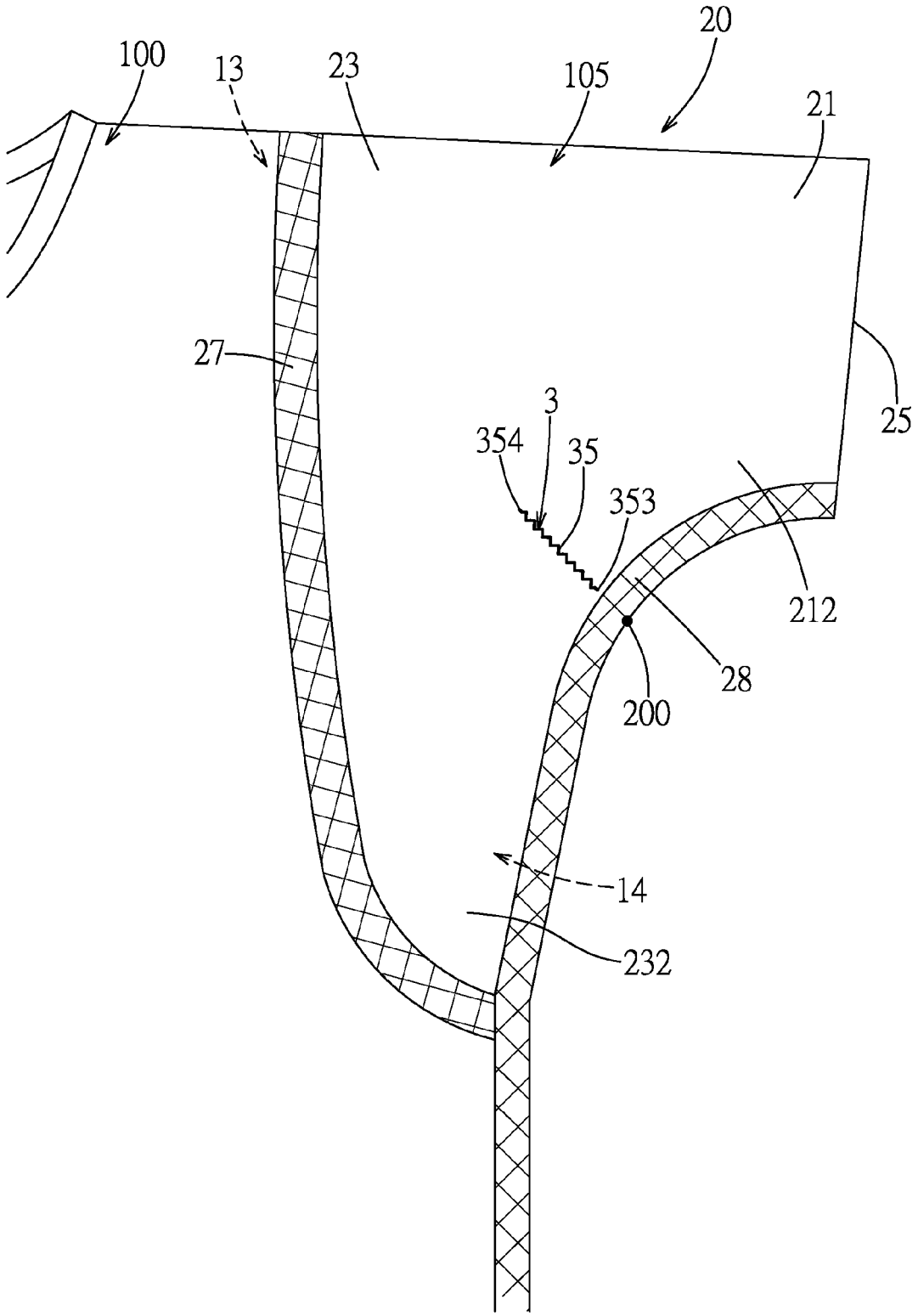
FIG. 12 is a schematic front view of the seventh embodiment of the anti-odor apparel according to the present invention.
Figure 13:
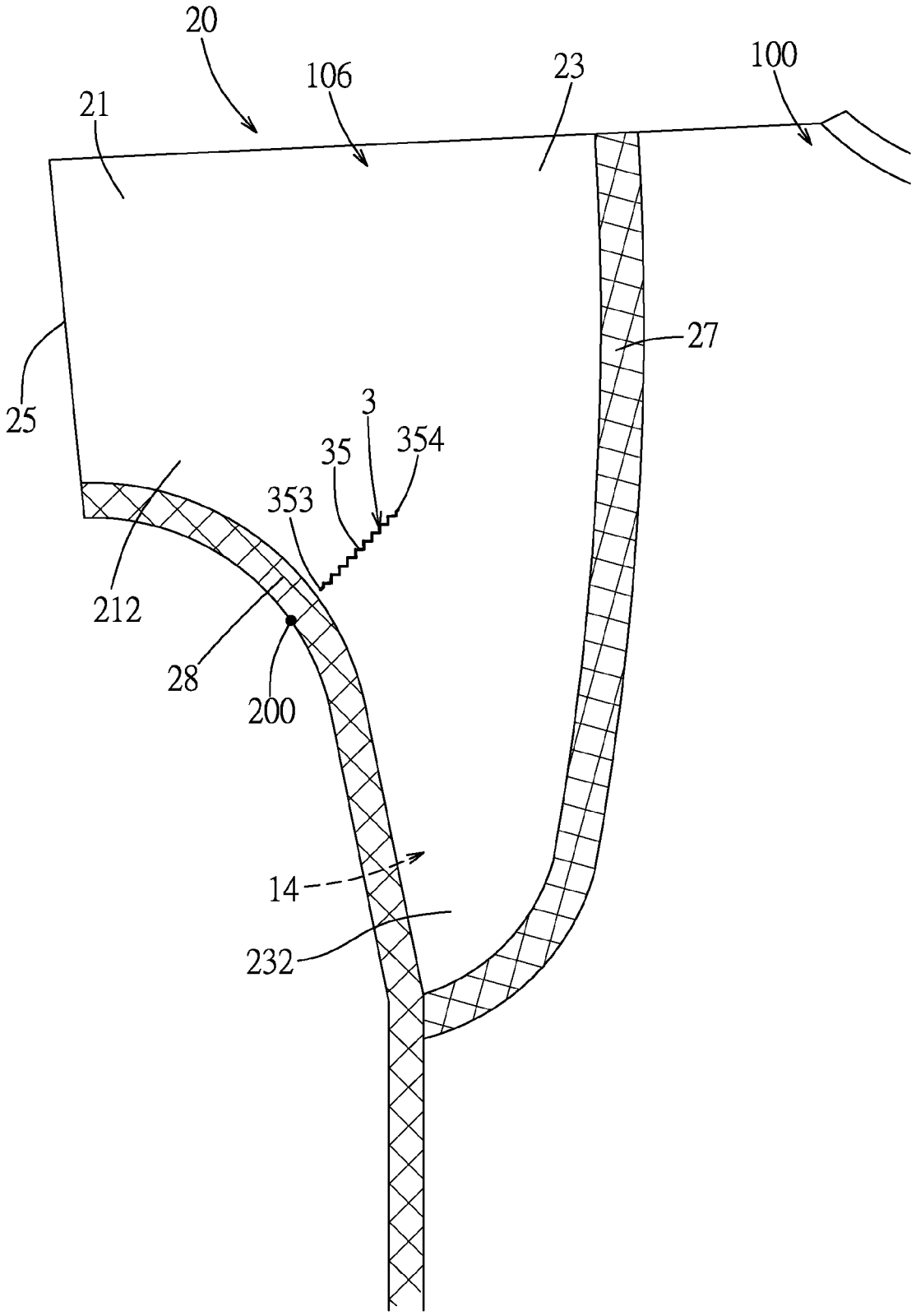
FIG. 13 is a schematic rear view of the seventh embodiment.

FIGS. 12 and 13 illustrate the seventh embodiment of the anti-odor apparel according to the present invention. The seventh embodiment differs from the fourth embodiment in that each of the lifting units 3 includes a pair of elastic members fastened to the extended sleeves 20. In this embodiment, the elastic members are elastic strings 35 which are disposed at and are spaced apart from two opposite sides of the generally curve-shaped sewing connection 28 and which are stitched to at least one of the lower end portions 212, 232 of the sleeve segment 21 and the extension segment 23 of a respective one of the extended sleeves 20. The elastic strings 35 are respectively disposed at the front and back sides 105, 106 of the anti-odor apparel, and extend between the loop-shaped sewing connection 27 and the curve-shaped sewing connection 28, such that each of the elastic strings 35 is held under tension so as to generate a lifting force that acts on at least one of the lower end portions 212, 232 of the sleeve segment 21 and the extension segment 23 to elastically lift the at least one of the lower end portions 212, 232 of the sleeve segment 21 and the extension segment 23 toward the user's underarm area 14. Preferably, each of the elastic strings 35 extends in a direction toward the armpit-location 200 of the anti-odor apparel, and has two opposite ends 353, 354. The end 353 of each of the elastic strings 35 is disposed adjacent to and is spaced apart from the curve-shaped sewing connection 28. Alternatively, the elastic strings 35 may intersect the generally curve-shaped sewing connection 28.

Figure 14:
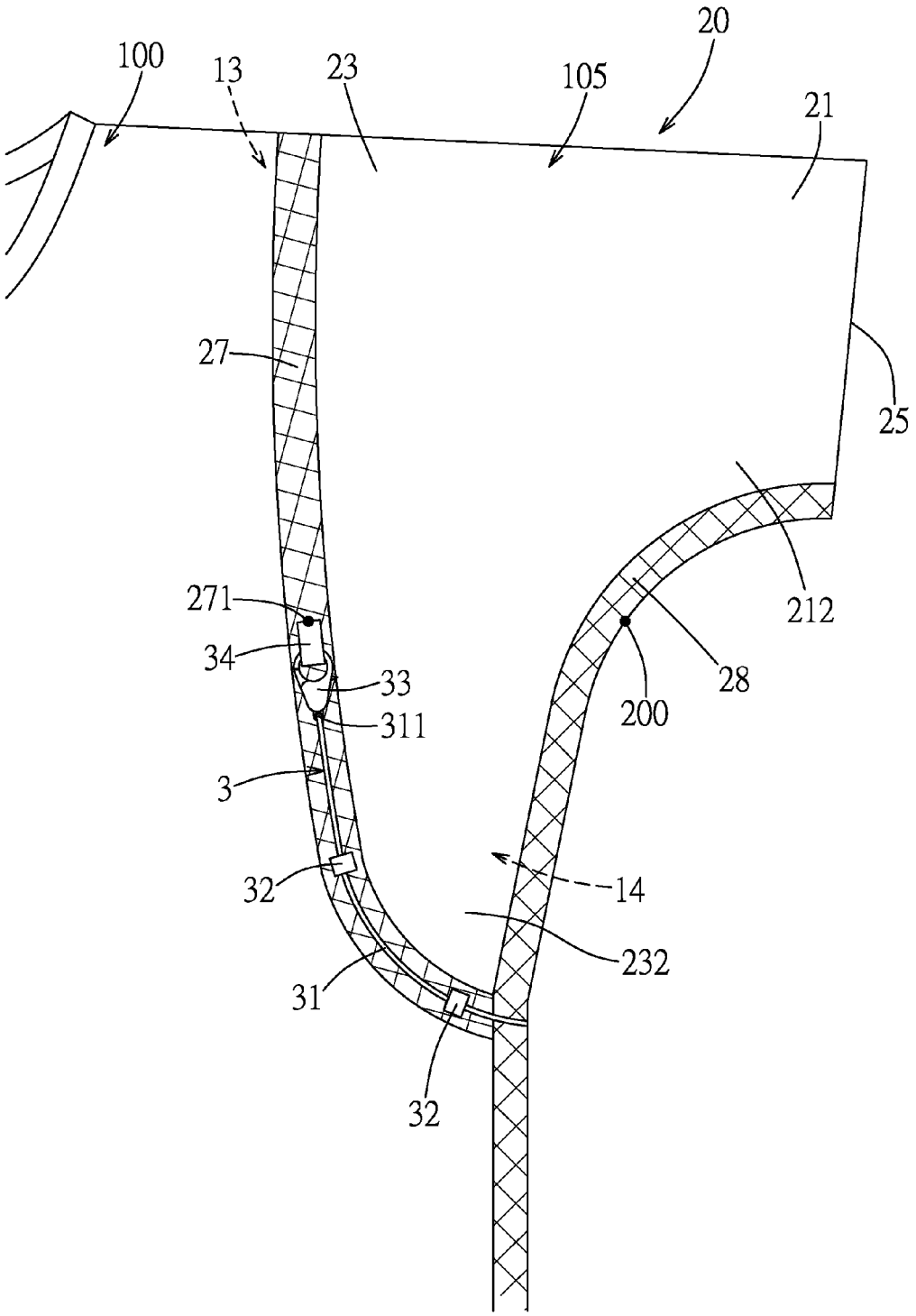
FIG. 14 is a schematic front view of the eighth embodiment of the anti-odor apparel according to the present invention.
Figure 15:
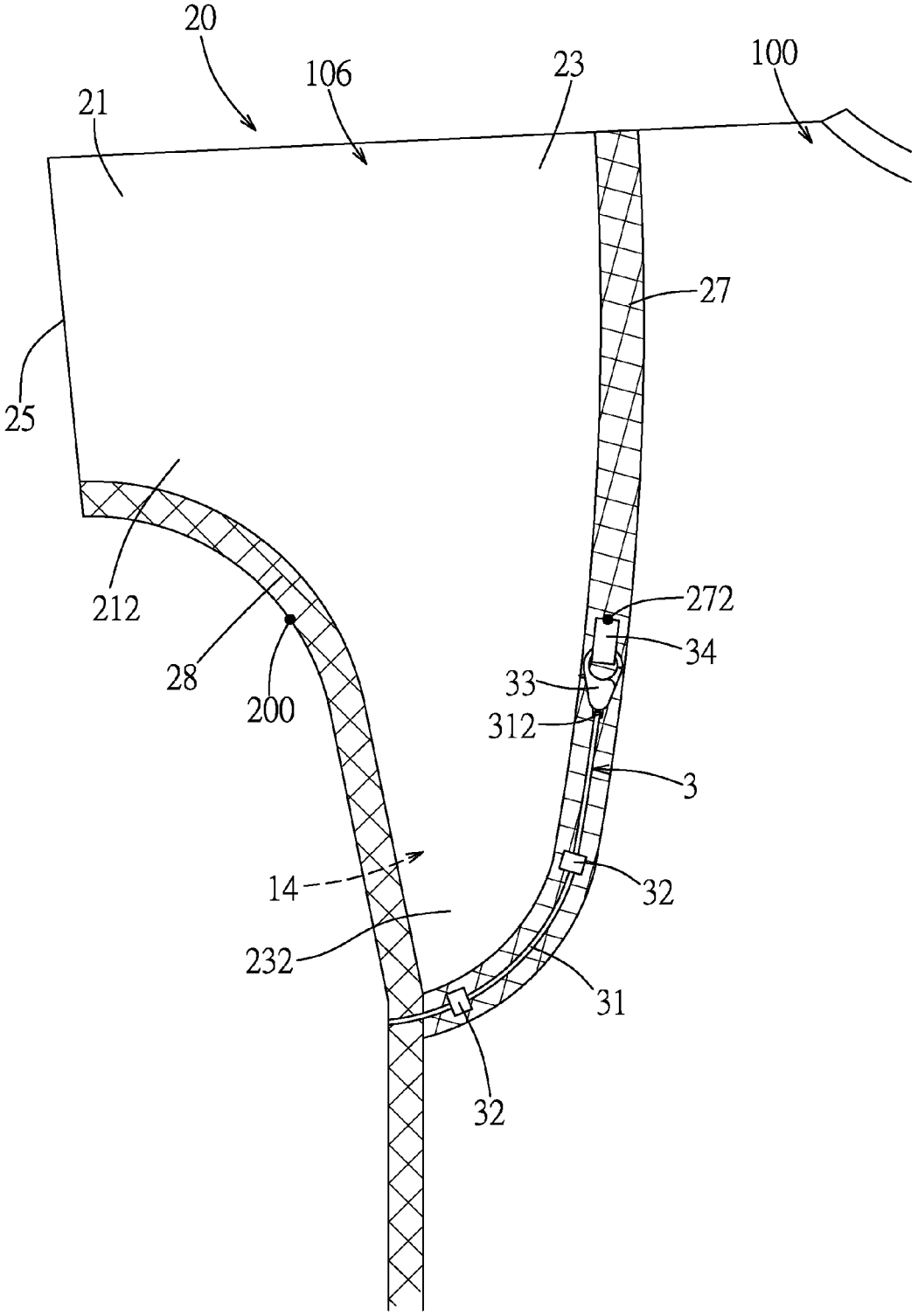
FIG. 15 is a schematic rear view of the eighth embodiment.

FIGS. 14 and 15 illustrate the eighth embodiment of the anti-odor apparel according to the present invention. The eighth embodiment differs from the fourth embodiment in that the first elastic string 31 is positioned at and extends along a U-shaped lower portion of a respective one of the loop-shaped sewing connections 27 that is opposite to the inverted U-shaped upper portion of the loop-shaped sewing connections 27.

Figure 16:
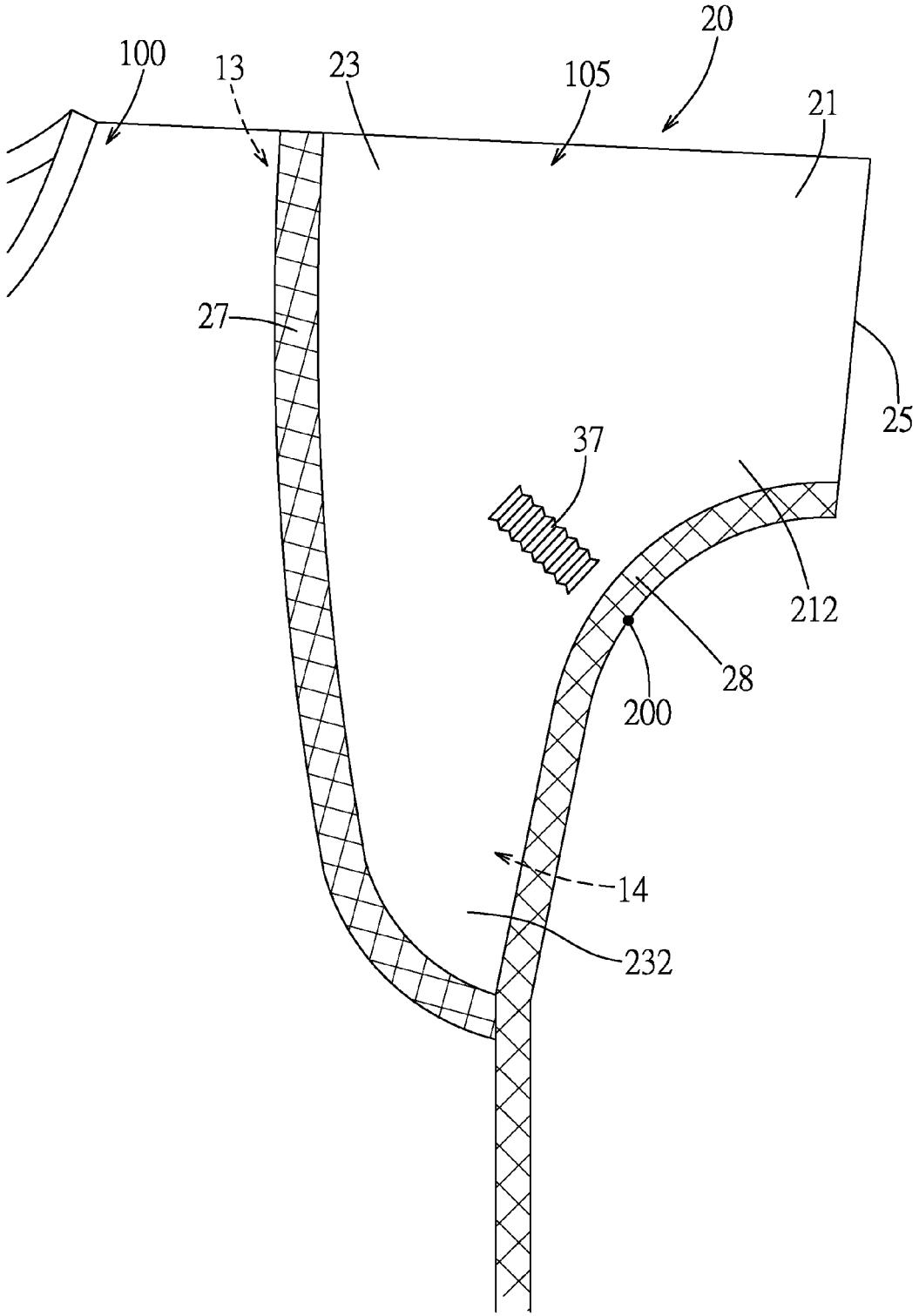
FIG. 16 is a schematic front view of the ninth embodiment of the anti-odor apparel according to the present invention.
Figure 17:
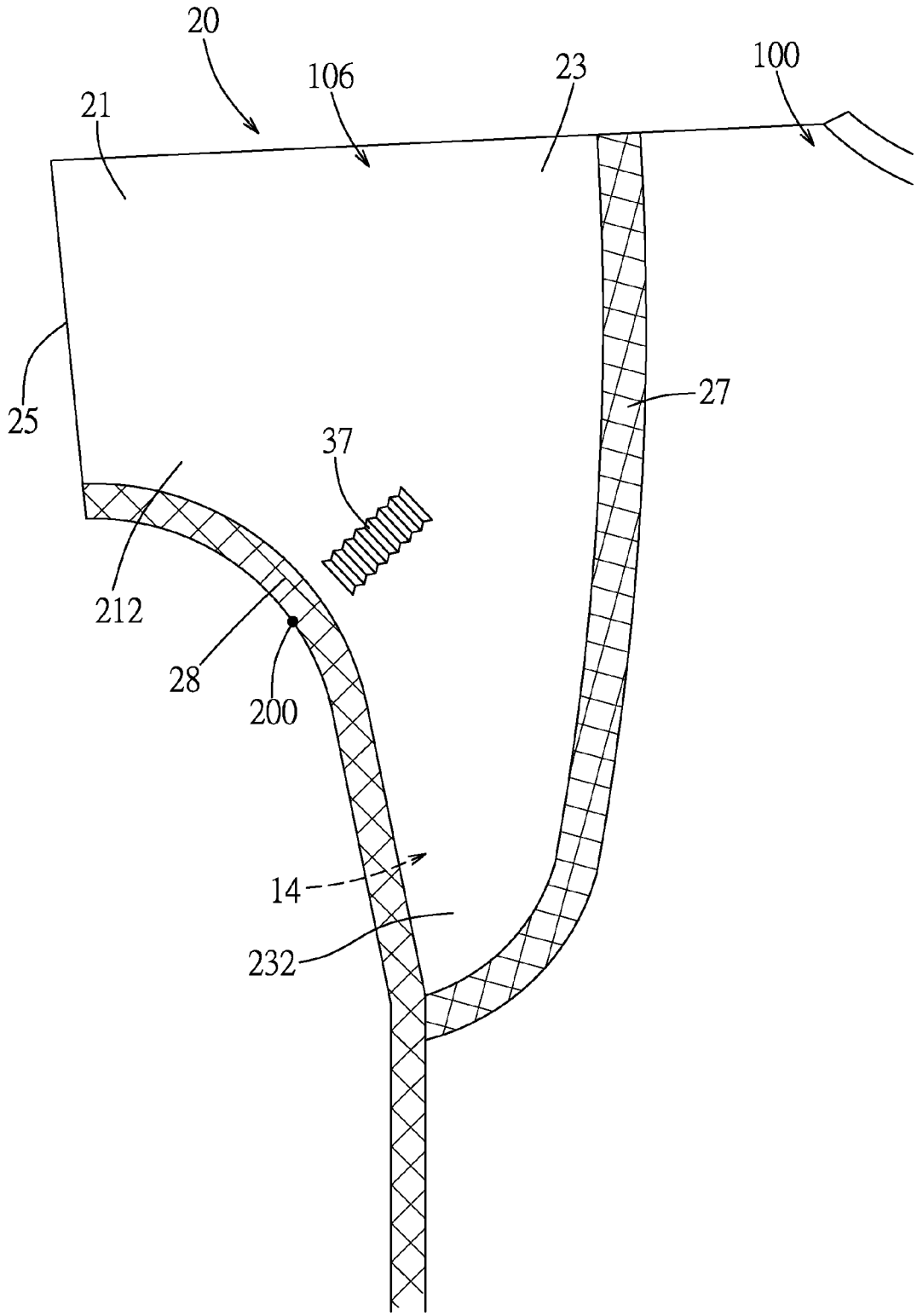
FIG. 17 is a schematic rear view of the ninth embodiment.

FIGS. 16 and 17 illustrate the ninth embodiment of the anti-odor apparel according to the present invention. The ninth embodiment differs from the seventh embodiment in that the elastic members are elastic bonding patches 37, which are adhesively bonded to at least one of the lower end portions 212, 232 of the sleeve segment 21 and the extension segment 23 of a respective one of the extended sleeves 20. The elastic bonding patches 37 are respectively disposed at the front and back sides 105, 106 of the anti-odor apparel, and extend between the loop-shaped sewing connection 27 and the curve-shaped sewing connection 28, such that each of the elastic bonding patches 37 is held under tension so as to generate a lifting force that acts on at least one of the lower end portions 212, 232 of the sleeve segment 21 and the extension segment 23 to elastically lift the at least one of the lower end portions 212, 232 of the sleeve segment 21 and the extension segment 23 toward the user's underarm area 14. The elastic bonding patches 37 may be made from fabrics or plastics.

With the inclusion of the first elastic string 31, which is positioned on and extends along the loop-shaped sewing connection 27, and/or the second elastic strings 35 or the elastic bonding patches 37, in the anti-odor apparel of the present invention, the aforesaid drawbacks associated with the prior art may be alleviated.

While the present invention has been described in connection with what are considered the most practical embodiments, it is understood that this invention is not limited to the disclosed embodiments but is intended to cover various arrangements included within the spirit and scope of the broadest interpretation and equivalent arrangements.

What is claimed is:

1. An anti-odor apparel comprising:

an upper body clothing that defines an open end;

an extended sleeve stitched to said open end of said upper body clothing to form a loop-shaped sewing connection, said loop-shaped sewing connection being configured to surround an underarm area of an upper body of the user, said extended sleeve having an open free end that is opposite to said loop-shaped sewing connection, a sleeve segment that extends from said open free end and that is configured to cover an arm area of the user, and an extension segment that extends from said sleeve segment to said loop-shaped sewing connection and that is configured to cover a portion of the shoulder area and a portion of the underarm area, said sleeve segment having a lower end portion, said extension segment having a lower end portion that extends from said lower end portion of said sleeve segment, said lower end portions of said sleeve segment and said extension segment being made from a functional fabric that has anti-odor effects, and being configured to be disposed underneath the underarm area for covering and contacting the underarm area; and a lifting unit including a first elastic string that has two opposite connecting end portions and that is positioned at and that extends along said loop-shaped sewing connection, said connecting end portions of said first elastic string being held to said loop-shaped sewing connection at two different lifting points of said loop-shaped sewing connection, respectively, such that said first elastic string is held under tension so as to generate a lifting force that acts on said extended sleeve to elastically lift at least one of said lower end portions of said sleeve segment and said extension segment toward the underarm area, wherein said extended sleeve further has a generally curve-shaped sewing connection that extends from said loop-shaped sewing connection to said open free end and that is disposed at said lower end portions of said sleeve segment and said extension segment, said lifting unit further including a second elastic string that is stitched to at least one of said lower end portions of said sleeve segment and said extension segment of said extended sleeve and that intersects said curve-shaped sewing connection, such that said second elastic string is held under tension so as to generate a lifting force that acts on at least one of said lower end portions of said sleeve segment and said extension segment to elastically lift said at least one of said lower end portions of said sleeve segment and said extension segment toward the underarm area.

2. An anti-odor apparel comprising:

an upper body clothing that defines an open end;

an extended sleeve stitched to said open end of said upper body clothing to form a loop-shaped sewing connection, said loop-shaped sewing connection being configured to surround an underarm area of an upper body of the user, said extended sleeve having an open free end that is opposite to said loop-shaped sewing connection, a sleeve segment that extends from said open free end and that is configured to cover an arm area of the user, and an extension segment that extends from said sleeve segment to said loop-shaped sewing connection and that is configured to cover a portion of the shoulder area and a portion of the underarm area, said sleeve segment having a lower end portion, said extension segment having a lower end portion that extends from said lower end portion of said sleeve segment, said lower end portions of said sleeve segment and said extension segment being made from a functional fabric that has anti-odor effects, and being configured to be disposed underneath the underarm area for covering and contacting the underarm area; and a lifting unit including a first elastic string that has two opposite connecting end portions and that is positioned at and that extends along said loop-shaped sewing connection, said connecting end portions of said first elastic string being held to said loop-shaped sewing connection at two different lifting points of said loop-shaped sewing connection, respectively, such that said first elastic string is held under tension so as to generate a lifting force that acts on said extended sleeve to elastically lift at least one of said lower end portions of said sleeve segment and said extension segment toward the underarm area, wherein said lifting unit further includes a plurality of positioning loops that are stitched to said loop-shaped sewing connection and that are spaced apart from one another, said first elastic string extending through said positioning loops so as to be positioned along said loop-shaped sewing connection.

3. An anti-odor apparel comprising:

an upper body clothing that defines an open end;

an extended sleeve stitched to said open end of said upper body clothing to form a loop-shaped sewing connection, said loop-shaped sewing connection being configured to surround an underarm area of an upper body of the user, said extended sleeve having an open free end that is opposite to said loop-shaped sewing connection, a sleeve segment that extends from said open free end and that is configured to cover an arm area of the user, and an extension segment that extends from said sleeve segment to said loop-shaped sewing connection and that is configured to cover a portion of the shoulder area and a portion of the underarm area, said sleeve segment having a lower end portion, said extension segment having a lower end portion that extends from said lower end portion of said sleeve segment, said lower end portions of said sleeve segment and said extension segment being made from a functional fabric that has anti-odor effects, and being configured to be disposed underneath the underarm area for covering and contacting the underarm area; and a lifting unit including a first elastic string that has two opposite connecting end portions and that is positioned at and that extends along said loop-shaped sewing connection, said connecting end portions of said first elastic string being held to said loop-shaped sewing connection at two different lifting points of said loop-shaped sewing connection, respectively, such that said first elastic string is held under tension so as to generate a lifting force that acts on said extended sleeve to elastically lift at least one of said lower end portions of said sleeve segment and said extension segment toward the underarm area, wherein said lifting unit further includes a first engaging member and a plurality of second engaging members, said first engaging member being secured to one of said connecting end portions of said first elastic string, said second engaging members being secured to said loop-shaped sewing connection and being spaced apart from one another, said first engaging member engaging releasably a selected one of said second engaging members to enable adjustment of the tension of said first elastic string.

4. The anti-odor apparel of claim 3, wherein said first and second engaging members are in the form of male and female snap buttons.

5. The anti-odor apparel of claim 3, wherein said first engaging member is in the form of a hook, and each of said second engaging members is in the form of a ring that is secured to said loop-shaped sewing connection.

6. The anti-odor apparel of claim 1, wherein said first elastic string is detachably connected to said loop-shaped sewing connection.

7. The anti-odor apparel of claim 2, wherein said first elastic string is detachably connected to said loop-shaped sewing connection.

8. The anti-odor apparel of claim 3, wherein said first elastic string is detachably connected to said loop-shaped sewing connection.

* * * * *